US010711587B2

(12) United States Patent
Burger et al.

(10) Patent No.: US 10,711,587 B2
(45) Date of Patent: Jul. 14, 2020

(54) OXIDIZING AGENT INJECTION EQUIPMENT FOR UNDERGROUND COAL GASIFICATION PROCESS AND APPLICATION THEREOF

(71) Applicant: ZHONGWEI (SHANGHAI) ENERGY TECHNOLOGY CO. LTD, Shanghai (CN)

(72) Inventors: Casper Jan Hendrik Burger, Shanghai (CN); Zhenhua Min, Shanghai (CN); Yuanli Wang, Shanghai (CN)

(73) Assignee: ZHONGWEI (SHANGHAI) ENERGY TECHNOLOGY CO. LTD, Shanghai (CN)

( * ) Notice: Subject to any disclaimer, the term of this patent is extended or adjusted under 35 U.S.C. 154(b) by 0 days.

(21) Appl. No.: 16/321,100

(22) PCT Filed: Aug. 24, 2016

(86) PCT No.: PCT/CN2016/096487
§ 371 (c)(1),
(2) Date: Jan. 28, 2019

(87) PCT Pub. No.: WO2018/035735
PCT Pub. Date: Mar. 1, 2018

(65) Prior Publication Data

US 2019/0162062 A1 May 30, 2019

(51) Int. Cl.
*E21B 43/295* (2006.01)
*E21B 43/16* (2006.01)
*E21B 43/243* (2006.01)

(52) U.S. Cl.
CPC ..... *E21B 43/295* (2013.01); *E21B 43/164* (2013.01); *E21B 43/166* (2013.01); *E21B 43/168* (2013.01)

(58) Field of Classification Search
CPC ..... E21B 43/295; E21B 43/243; E21B 17/00; E21B 43/305
See application file for complete search history.

(56) References Cited

U.S. PATENT DOCUMENTS

2010/0139915 A1* 6/2010 Dreher, Jr. ..... E21B 43/243 166/256

FOREIGN PATENT DOCUMENTS

AU 2013101616 A4 1/2014
CN 104895545 A 9/2015
(Continued)

OTHER PUBLICATIONS

International Search Report; PCT/CN2016/096487; dated Mar. 30, 2017.

*Primary Examiner* — Zakiya W Bates
(74) *Attorney, Agent, or Firm* — Dunlap, Bennett & Ludwig, PLLC

(57) ABSTRACT

An oxidant injection device for an underground coal gasification process includes an oxidant pathway which includes a swivel joint, coiled tubing, and a mechanical shear-off device which are in gas tight connection with each other in that sequence. Attached to the mechanical shear-off device is an oxidant nozzle, wherein the shear-off device is adapted to shear the oxidant nozzle to allow retraction of the coiled tubing when necessary, and wherein the swivel joint causes the surface oxidant source to be in gas tight connection with the coiled tubing reel center shaft, thereby allowing continuous oxidant injection during the process of moving the oxidant nozzle via the movement of the coiled tubing when rotating the coiled tubing reel.

15 Claims, 3 Drawing Sheets

(56) References Cited

FOREIGN PATENT DOCUMENTS

| | | | |
|---|---|---|---|
| CN | 105178935 | A | 12/2015 |
| EP | 2787164 | A1 | 10/2014 |
| WO | 2014043747 | A1 | 3/2014 |
| WO | 2014186823 | A1 | 11/2014 |

* cited by examiner

OXIDIZING AGENT INJECTION EQUIPMENT FOR UNDERGROUND COAL GASIFICATION PROCESS AND APPLICATION THEREOF

TECHNICAL FIELD

This invention provides an oxidant injection device for the underground coal gasification process. In particular, the present invention provides an oxidant device for continuous injection of a high oxygen concentration oxidant for the underground coal gasification process. In addition, it also provides the operational applications of this oxidant injection device during the underground coal gasification process, including the underground coal gasification ignition and normal operation processes.

BACKGROUND ART

Underground coal gasification (UCG or ISC) is a process by which a coal seam is converted into a product gas, by combusting and gasifying the coal in-situ in the presence of an oxidant. The product gas is typically referred to as synthesis gas or syngas and can be used as a feedstock for various applications, including fuels production, chemicals production and power generation. The underground coal gasification technology is suitable for most coal reserves. Due to the environmental requirements for mining industry becoming increasingly strict, and considering relevant labour cost and construction cost, the technology is undoubtedly very attractive.

No matter whether the coal gasification process is conducted in-situ or on the surface, it is a series of chemical reactions converting coal into gas products. Generally, the chemical reactions involved are as following, wherein $H_2O$ and $CO_2$ are the main gasification agents and $O_2$ is the main oxidant:

$C+O_2 \rightarrow CO_2$ (Complete oxidation reaction)

$CO+½)_2 \rightarrow CO$ (Partial oxidation reaction)

$C+H_2O \rightarrow H_2+CO$ (Steam gasification reaction)

$C+2H_2 \rightarrow CH_4$ (Hydrogen gasification reaction)

$C+CO_2 \rightarrow 2CO$ (Carbon dioxide gasification reaction)

$CO+H_2O \Leftrightarrow H_2+CO_2$ (Water gas shift reaction)

$CO+3H_2 \Leftrightarrow CH_4H_2O$ (Methanation reaction)

During the underground coal gasification process, a sub-surface completed well system is generally set up in the coal seam. The above mentioned completed well system includes injection well for injecting a variety of agents such as oxidant, gasification agent and coolant etc., a production well for removing product gas and other support wells, wherein casing and/or well liner are generally inserted in the injection well, production well and other support wells to connect each other, wherein the above mentioned support wells generally include the ignition well, syngas quench well, guard well, etc., and wherein, the injection well is generally a horizontal directional well while the production well and support well can generally be either horizontal directional wells or vertical wells.

Therefore, during the underground coal gasification process, the basic or most simple completed well system consists of an injection well and a production well, linked and provisioned with a casing and/or well liner. This is typically referred to as an underground coal gasifier unit or well pair.

During the underground coal gasification process, the relevant sub-surface zones include the combustion zone, gasification zone and pyrolysis zone, wherein: the combustion zone is in close proximity to the oxidant and gasification agent injection point, and coal is combusted and gasified in the presence of oxidant in the combustion zone; the gasification zone is located downstream of the combustion zone or radically around combustion zone, and coal is gasified and partially oxidized to produce product gas in the gasification zone; the pyrolysis zone is located downstream of the gasification zone, and pyrolysis reactions of coal occurs in the pyrolysis zone. The pyrolysis reactions of coal are generally not expected for a well-controlled underground coal gasification process. As coal is consumed or gasified, an underground coal gasification cavity within the coal seam develops and grows in size. This represents a gradual progression of the underground coal gasification process, until sub-surface coal reserve is completely consumed, leaving ash inside the coal seam.

During the underground coal gasification process, the produced product gas is referred to as raw syngas, which usually includes CO, $CO_2$, $H_2$, $CH_4$ and solid particles, water, coal tar and hydrocarbons, and small amount of $H_2S$, $NH_4$ and COS etc. The actual composition of the above-mentioned product gas is dependent on multiple factors, including the oxidant used air, oxygen-enriched air, or pure oxygen), presence of water (coal seam water or ingress water from surrounding strata into the coal seam), coal quality and process parameters used (temperature and pressure etc.).

In the underground coal gasification process, it is generally preferred to use an oxidant with a higher oxygen concentration, since it can produce a better-quality product gas, specifically a higher syngas calorific value. However, if the oxygen concentration is high, such as above 35 vol %, it is necessary to use a coolant at the same time to reduce the risks of the high temperature in the combustion zone, the high burn-back rate and damage to the injection well liner. Therefore, it is beneficial to safely use high-concentration oxidants such as pure oxygen for the underground coal gasification process.

In addition, in present art, continuous injection of oxidant generally cannot be realized during the underground coal gasification process. In particular, when it is necessary to change the oxidant injection position during the underground coal gasification process, the oxidant injection is usually stopped. For example, for the underground coal gasification process utilising the retraction method, the oxidant injection point is generally required to be retracted periodically. As an example, the oxidant injection point is required to be retracted by 50 m after a 30 days' continuous gasification period, wherein the retraction process generally requires termination of oxidant injection. In this situation, the underground coal gasification process cannot be considered to be "continuous", and such "discontinuity" could cause fluctuations of product gas quality, wherein large syngas property fluctuations can lead to operational challenges to downstream syngas processing applications. Therefore, it is beneficial if the real continuous oxidant injection operation can be implemented for the underground coal gasification process.

WO2014/043747 A1 published a device and method for carrying out an oxygen-enriched underground coal gasification process. It provides detailed oxygen injection device and method, wherein a specially designed oxygen lance is used to inject oxidant into an underground coal seam, and the mentioned oxygen lance comprises: a lance body having an internal pathway with a check valve inserted therein; a coiled tubing adapter connected to the rear end of the lance body, including a hole for inserting a thermocouple cable; at least one spacer tube connected to the forward end of the lance body; an injection nozzle connected to the forward end of the spacer tube; and a thermocouple for monitoring the temperature of the injection nozzle. Although the art mentioned the oxygen-enriched underground coal gasification process, the actual operation is the air blown process.

WO2014/186823 A1 published an oxidant and water injection device and method for underground coal gasification, wherein the device includes an oxidant conduit and a casing seal. The above-mentioned oxidant conduit has at least one opening at a downhole end and an upper end for injecting oxidant into the underground coal gasifier, where the upper open end is adapted for hydraulically connecting the flow conduit to the coiled tubing conduit; and the above mentioned casing seal is adapted for sealing the annulus between the oxidant conduit and the casing of a cased wellbore, where the casing seal has one or more pathways for injecting water into the underground coal gasifier. Although the oxidant can be substantially pure oxygen, the controlled retraction injection point (CRIP) method is applied, which corresponds to the underground coal gasification process in current art, wherein the process is separated by multiple retraction phases.

In summary, in the prior art, the underground coal gasification process still needs to be improved in some aspects, including: how to better control the combustion and gasification within the coal seam to provide high quality product syngas; how to achieve moving or retraction of oxidant injection device without interrupting oxidant injection; how to prevent the high downhole temperature to damage the oxidant injection device and fuse to the well liner in the horizontal wellbore; and how to better conduct subsurface monitoring to control the underground coal gasification process.

Therefore, further improvements are required to the current technology for underground coal gasification, especially to achieve continuous oxidant injection operation and the safe use of highly concentrated oxidant such as pure oxygen.

SUMMARY OF INVENTION

In view of the prior art, the present invention provides an oxidant injection device for underground coal gasification process. In particular, the present invention provides an oxidant injection device for continuous injection of a high oxygen concentration oxidant during the underground coal gasification process. It also provides the operational application of the oxidant injection device during underground coal gasification process, which can be used during ignition and normal operation for the underground coal gasification process.

The present invention provides an oxidant injection device for the underground coal gasification process. The above-mentioned oxidant injection device includes an oxidant flow path, and the gas tight connected components of the oxidant flow path in connection order are: swivel joint, coiled tubing, mechanical shear-off device, and oxidant nozzle. The above-mentioned mechanical shear-off device provides the capability to shear off the oxidant nozzle in the event of the oxidant nozzle becoming stuck in sub-surface, which allows the coiled tubing to be pulled back to surface, during which the above-mentioned swivel joint connects the coiled tubing reel central shaft gas tight to the surface oxidant source, therefore allowing continuous operation of oxidant injection during oxidant nozzle movement by rotating the coiled tubing reel.

This invention also provides a method for the underground coal gasification process, wherein a completed well system is set up in the sub-surface coal seam; wherein using the oxidant injection device in this invention to continuously inject high purity oxidant and coolant through the injection well; wherein the above-mentioned high purity oxidant is to be oxygen-enriched air that contains at least 80 vol %, preferably oxygen-enriched air that contains at least 90 vol % or pure oxygen. The annulus between the coiled tubing and the injection well liner, is used as an auxiliary flow path to inject coolant. The above-mentioned coolant is water, steam or carbon dioxide, and the coolant is also utilized as gasification agent during the coal gasification process.

According to this invention, the above mentioned oxidant injection device combines the corresponding characteristics and functions of the various components, in particular the combined utilization of a swivel joint and coiled tubing, which allows not only continuous operation of oxidant injection without interruption during the underground coal gasification process, achieving true continuous operation of the underground coal gasification process, but also safe and stable use of highly concentrated oxidant such as pure oxygen, and therefore enables production of stable high quality product gas, bringing improvements to the current technology.

According to this invention, when applying the retraction method for the underground coal gasification process, the complex disassembly and assembly operations after interrupted oxidant injection are not required during the oxidant nozzle movement process, when using the oxidant injection device in this invention. This operation is more flexible and convenient than the current operation. Hence, it significantly reduces the retraction period and/or distance compared to current technologies, allowing the continuous movement of the gasification location within the sub-surface coal seam during the underground coal gasification process.

Therefore, according to this invention, a retraction method with short retraction period and distance during the underground coal gasification process is achieved. The above-mentioned retraction period can be significantly reduced from at least 30 days in prior art to 2 weeks, or further reduced to a few days, or even reduced to 1 day. The above-mentioned retraction distance can also be significantly reduced from 50 m in prior art to 10 m, or further reduced to 5 m, or even reduced to 1 m. Therefore, the continuous movement of the gasification location within the sub-surface coal seam is achieved during the underground coal gasification process, which is undoubtedly favourable to produce a higher quality and more stable product gas, bringing improvements to the existing technology.

BRIEF DESCRIPTION OF DRAWINGS

This present invention will be further described with reference to drawings below, wherein.

In the figures, like reference numerals refer to like parts. In detail, the meanings of each numeral in the figures are as following.

Figure 1:
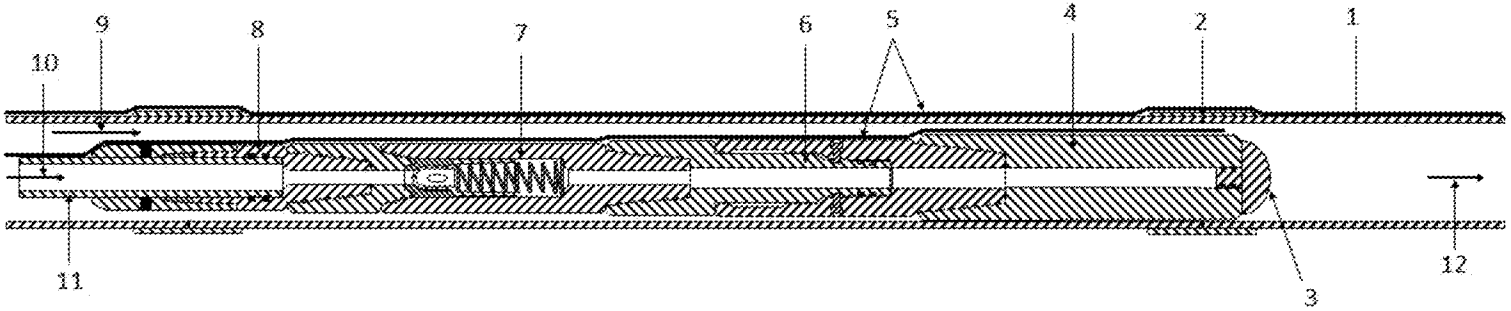
FIG. 1 is a cross sectional view of a portion of the oxidant injection device of this invention located in the sub-surface injection well liner.

1. Injection well liner; 2. Casing coupling; 3. Blow-off plug; 4. Oxidant nozzle; 5. Distributed temperature, pressure and acoustic sensors; 6. Mechanical shear-off device; 7. Non-return valve (NRV); 8. Coiled tubing external grapple connector; 9. auxiliary flow path (the annulus between coiled tubing and injection well liner); 10. Oxidant flow path; 11. Coiled tubing; 12. Gasification zone; 13. Ignition device; 14. Injection well casing; 15. Wellhead coolant/air injection port; 16. Wellhead back-up coolant injection port; 17. Wellhead control equipment; 18. Coiled tubing reel (instruments and data transmitting lines are connected in the centre shaft); 19. Swivel joint; 21. Surface oxidant pipeline.

DESCRIPTION OF EMBODIMENTS

This Invention provides an oxidant injection device for the underground coal gasification process. In particular, the present invention provides an oxidant injection device with continuous injection of a high oxygen concentration oxidant during the underground coal gasification process. It also provides the operational application of the oxidant injection device during the underground coal gasification process, which can be used during ignition and normal operation for the underground coal gasification process.

The present invention provides an oxidant injection device for the underground coal gasification process. The above-mentioned oxidant injection device includes an oxidant flow path, and the gas tight connected components of the oxidant flow path in connection order are: swivel joint, coiled tubing, mechanical shear-off device, and oxidant nozzle. The above-mentioned mechanical shear-off device provides the capability to shear off the oxidant nozzle in the event of the oxidant nozzle becoming stuck in sub-surface, which allows the coiled tubing to be pulled back to surface, during which the above-mentioned swivel joint connects the coiled tubing reel centre shaft gas tight to the surface oxidant source, therefore allowing continuous operation of oxidant injection during oxidant nozzle movement by rotating the coiled tubing reel.

According to this invention, among the oxidant injection devices, the above-mentioned swivel joint is a gas tight sealed swivel joint that is specifically designed and manufactured to suit the high pressure and pure oxygen environment. The utilization of the swivel joint achieves a gas tight connection between the surface oxidant source and the coiled tubing reel centre shaft, which allows continuous operation of oxidant injection during the oxidant nozzle retraction by rotating the coiled tubing reel. For example, the swivel joint ensures continuous operation of high purity oxidant injection such as pure oxygen when the oxidant nozzle is being retracted by coiled tubing during the underground coal gasification process. Therefore, achieving continuous underground coal gasification operation in terms of operating time.

According to this invention, among the oxidant injection devices, the above-mentioned swivel joint can be any suitable sealed swivel joint used in prior art. For example, the swivel joint published in U.S. Pat. No. 3,884,511 and CN104279385B can be applied in this invention with suitable adjustments, which is incorporated herein by reference in its entirety.

According to this invention, among the oxidant injection devices, the above-mentioned coiled tubing is the main component of the oxidant flow path, with the main function to deliver oxidant, and transfer the oxidant nozzle and ignition device to the proposed location in the sub-surface coal seam.

According to this invention, among the oxidant injection devices, the above-mentioned coiled tubing connects to other components by using a special connector which does not require welding such as an external grapple connector, which can still provide a gas tight seal at the operating pressure range. Therefore, the external grapple connector enables easier maintenance and replacement of other components connected to the oxygen flow path.

The coiled tubing is a highly gas tight component to prevent any leakage of high concentration oxidant such as pure oxygen and therefore avoid any existence of safety hazards during the application of pure oxygen. The coiled tubing is generally wrapped onto the coiled tubing reel and achieves the coiled tubing retraction and retrieval by rotating the coiled tubing reel. A centre shaft is located inside the coiled tubing reel and this centre shaft is linked to the internal flow path of the coiled tubing main body. The above-mentioned swivel joint achieves continuous oxidant supply during coiled tubing movement by linking the oxidant source with the internal flow path of the coiled tubing main body through the coiled tubing reel centre shaft.

The coiled tubing string and its reel are selected for the correct operational length to access the coal at the required depth and horizontal in-seam length. The outside diameter of coiled tubing is generally selected to achieve the desired hydraulic flow rate and the allowable pressure drop. The material type and wall thickness for the coiled tubing is generally selected according to the injection coolant quality, desired operational life of the underground coal gasification process, expected frequency of entering sub-surface coal seam and the oxygen flow rate. Generally, 316L stainless steel or higher material grades meets the requirements for corrosion resistance, erosion resistance and oxidation resistance.

Temperature, pressure and acoustic sensors can be arranged on the outer wall of the coiled tubing. The terminals of these sensors are generally arranged in the centre shaft of the coiled tubing, whereby the detection points of these sensors can be extended and delivered to the sub-surface coal seam with the coiled tubing. Wireless transmitters are typically installed inside the coiled tubing to transfer the measured signal back to the control system. The coiled tubing reel centre shaft is custom designed and manufactured and thoroughly cleaned to meet the requirements for high concentrations of oxidant such as pure oxygen.

According to this invention, among the oxidant injection devices, the above-mentioned mechanical shear off device employs a self-breaking mechanism, to provide the capability to shear off the oxidant nozzle in the event of the oxygen nozzle becoming physically stuck inside the well liner, (e.g. when the oxidant nozzle is stuck inside the injection well liner due to failure such as deformation or distortion, or is stuck due to melting of the liner in the injection well) to retract the coiled tubing, and repair and/or replace the oxidant nozzle for further operation.

Because of the integration of the mechanical shear off device in the design, most parts of the oxidant injection device can be retracted successfully to surface for maintenance and/or replacement if it is necessary, such as when the oxidant nozzle fails, which could reduce equipment loss during the underground coal gasification process, to a certain extent.

According to this invention, among the oxidant injection devices, one or more non-return valves (NRV) are connected between the coiled tubing and the mechanical shear off device in the oxidant flow path, wherein the use of multiple NRV's are regarded as back-up. The NRV's are primarily used to prevent reverse flow from entering into the coiled tubing, allowing to keep relevant parts of the oxidant injection device clean and ensure safety upon removing or retracting devices at the wellhead. The above mentioned NRV can be any type of NRV, known by technical persons skilled in the art, which is suitable for highly concentrated oxidant such as pure oxygen. For example, it can be spring loaded flapper valve, ball & spring, or the like.

According to this invention, among the oxidant injection devices, the oxidant nozzle is at the tip of the oxidant flow path where the oxidant is delivered and distributed into subsurface coal seam. Therefore, the oxidant nozzle is a key component of the oxidant injection device of the present invention, and is usually also the location of the oxidant injection device failure, which therefore requires suitable design and use.

According to this invention, the above-mentioned oxidant nozzle must be suitable for high temperature, high pressure, and high velocity flows of highly concentrated oxidant such as pure oxygen, as well as the high temperature environment near the subsurface combustion zone in the coal seam; the material of the above mentioned oxidant nozzle must be selected accordingly, for example, the material can be Brass, Inconel, Monel and Copper-Nickel Alloys; the external surface of the above mentioned oxidant nozzle is to be smooth and any dimensional changes in outside diameter (OD) of the nozzle should have a gradual transition to allow for smooth movement inside the injection well liner. Additionally, the above-mentioned oxidant nozzle must have sufficient wall thicknesses to provide adequate cross-sectional areas for strength and to meet the requirements for heat dissipation and cooling and to minimise kindling burn back of any components which are exposed to high temperature and high heat flux from the coal combustion process, in order to ensure integrity and reliability of the oxidant nozzle.

According to this invention, the internal oxygen flow path in the above-mentioned oxidant nozzle is to be suitable for highly concentrated oxidant such as pure oxygen, wherein the internal flow path must be cleaned to be without particulates and hydrocarbon contamination and the internal surfaces should be specially machined to meet the requirements of pure oxygen service. In addition, the above-mentioned oxidant nozzle is designed to have an adjustable outside diameter (OD) to allow for changes to the annular space between the oxidant nozzle OD and horizontal well liner inside diameter (ID) to control coolant flow rate, resulting in the enhancement or reduction of heat dissipation at the oxidant nozzle.

According to this invention, the above-mentioned oxidant nozzle can consist of a nozzle tip with a single hole or multiple holes. The single hole tip is sized to achieve maximum exit velocity which will entrain more coolant within the oxygen flow towards the gasification zone. For the multiple hole tip, the holes can be parallel to each other around the centre for a narrow-focussed distribution of oxygen into the gasification zone or at certain angles such as 5-35°, preferably 8-20°, in relation to each other to increase the distribution/projection area of oxygen into the gasification zone. Furthermore, the above-mentioned oxidant nozzle can have a specially designed micro-flow pattern, such as venturi/flow entrainment channels near the tip of the nozzle head at 2-20 mm, preferably 3-15 mm, distance from the nozzle tip, to guide coolant to the above-mentioned holes to allow for coolant protection of the nozzle tip.

According to this invention, the above-mentioned oxidant nozzle has a blow-off plug which generally has a rounded shape, and is placed at the tip of the oxidant nozzle to protect the oxidant nozzle and maintain the cleanliness inside the device before being place into operation. It will be blown off by high pressure oxidant flow upon operation commencement when oxidant is injected, which means that the blow-off plug will not block the oxidant injection.

According to this invention, when applying the retraction method during the underground coal gasification process, the above-mentioned oxidant nozzle can be retracted for a certain distance inside the injection well liner on a regular basis, by rotating the coiled tubing reel, to completely consume the sub-surface coal reserves around the injection well liner section by section, leaving ash within in the coal seam.

This invention also provides a method for the underground coal gasification process, wherein an underground coal gasification well completion system is set up within the sub-surface coal seam, wherein the high-concentration oxidant is continuously injected into the sub-surface coal seam through the injection well, by using the oxidant injection device in this invention, wherein the high concentration oxidant is oxygen-enriched air or pure oxygen comprising at least 80 vol % oxygen, preferably at least 90 vol % oxygen. The annulus between the coiled tubing of the oxidant injection device and the injection liner is also formed, which is used as an auxiliary flow path to inject coolant and the above-mentioned coolant can be water, water vapour or carbon dioxide, and the coolant is simultaneously used as gasification agent for the underground coal gasification process.

Therefore, when using the oxidant injection device in this invention, during the underground coal gasification process, the annulus between the coiled tubing and the injection well liner can be used as an auxiliary flow path, which can be used not only for coolant, but also for injecting other required reagents into the subsurface coal seam when needed, wherein the other required reagents can include, for example, gasification agents, ignition oxidants, etc.

According to this invention, in the above-mentioned underground coal gasification method, the coolant injected into the subsurface coal seam, through the coolant flow path, has the following main functions: the heat around the oxidant nozzle can be removed by heat exchange to avoid high temperature damage to the oxidant nozzle; when applying the retraction method, the combustion consumption rate of the horizontal well liner in front of the oxidant nozzle can be accelerated by reducing the coolant flow rate. For example, the coolant flow rate can be reduced to 10-80%; when using water, steam or carbon dioxide as coolant, these coolants can also be used as gasification agents for the underground coal gasification process.

For example, when using water as the coolant, it will be converted to steam near the oxidant nozzle and inside the downstream gasification zone. At this time, the process temperature is controlled by the ratio of water and steam, which can enhance the gasification (partial oxidation) of hydrocarbons including solids (carbon), liquids (coal volatile matter and pyrolysis liquids), and gases (coal bed methane, pyrolysis vapours and syngas) rather than the combustion (complete oxidation) of hydrocarbons.

According to this invention, the high concentration oxidant used in the above-mentioned underground coal gasification method is oxygen-enriched air with at least 80 vol % oxygen, preferably oxygen-enriched air with at least 90 vol % oxygen or pure oxygen. This high concentration oxidant can be used to produce syngas with a better quality, specifically a higher calorific value. However, a coolant is also required when using high concentration oxidant. The above-mentioned coolant can be water, steam or carbon dioxide, preferably water or carbon dioxide. The coolant can be simultaneously used as a gasification agent for the underground coal gasification process, thereby improving the underground coal gasification process.

According to this invention, pure oxygen is preferred as oxidant. Water or carbon dioxide is preferred as coolant for the above-mentioned underground coal gasification method. The selected coolant is to be injected at a certain molar ratio to the pure oxygen. Specifically, the molar ratio of the injected coolant (water or carbon dioxide) and the injected oxidant (pure oxygen) can be ranged from 0.5 to 6.0, preferably from 1.0 to 5.0, and the even more preferably from 1.5 to 4.0.

According to this invention, in the above-mentioned underground coal gasification method, temperature, pressure and acoustic sensors are installed on the outside of the casing string of the injection well vertical section, outside the injection well liner, outside the coiled tubing, and at the oxidant nozzle. The temperature, pressure and acoustic signals from the subsurface coal seam are measured and transferred to the control system near the injection wellhead.

According to this invention, the above-mentioned temperature, pressure and acoustic sensors are based on the distributed sensing optic fibre in Optical Time-Domain Reflectometry (OTDR) measurement technology. The above-mentioned optic fibre extends from the coiled tubing reel centre shaft near the surface wellhead of the injection well to the measurement point at the far end, to obtain the corresponding temperature profile, pressure curve and acoustic curve in order to monitor the oxidant injection location, combustion zone location, subsurface coal seam consumption, temperature and pressure in the gasification zone, and the integrity of the well system, to control the gasification process. The temperature sensor can also be a bi-metallic sheathed duplex type-K thermocouple, for example, a bi-metallic sheathed duplex type-K thermocouple can be used to duplicate or replace the sensor at the oxidant nozzle tip, to obtain the temperature at this point and to control the coolant flow rate based on the temperature input.

In particular, according to this invention, the functions of the temperature, pressure and acoustic sensors are described below:

The temperature, pressure and acoustic sensors fixed to the outside of the injection well casing string vertical section, are mainly used as data sources for the safety protection systems. The operation of the entire system can be automatically terminated by stopping oxidant injection when the temperature is too high and/or pressure is too high (e.g. when the temperature and/or pressure at this location reaches a threshold or exceeds the design);

The temperature, pressure and acoustic sensors fixed outside the injection well liner is mainly used for monitoring gasification zone temperature and pressure in the sub-surface coal seam. These sensors generally extend through the instrument port of surface wellhead device and extend from surface wellhead device to the gasification zone, and transfer measurement feedback to the control system and stored in the database. Generally, when the gasification zone temperature exceeds 600° C., for example 600-1200° C., it can be considered that the coal seam along the injection well liner is being gasified and when the temperature is higher than 1,200° C., mainly coal combustion occurs. Furthermore, the operation of the entire system can also be automatically terminated when the subsurface coal seam along the horizontal pathway is completely consumed.

The temperature, pressure and acoustic sensors fixed on the outer wall of coiled tubing extend from the coiled tubing reel centre shaft at surface, all the way to the down hole oxidant nozzle, and are connected to wireless transmitter devices to transfer the instrumentation signals to the control system and stored in the database. The temperature and pressure sensors are mainly used for monitoring the temperature profile along the coiled tubing, the temperature at the oxidant nozzle and the gasification zone pressure in the sub-surface coal seam. The acoustic sensor is mainly used to identify the location of the oxidant nozzle. The control system can also make use of the acoustic signals to detect events which indicate impacts to well integrity; and The bi-metallic sheathed duplex type-K thermocouple can be added or utilized as replacement near the oxidant nozzle tip, to obtain the corresponding temperature at this point and control the coolant injection flow rate based on this temperature.

According to this invention, based on the above-mentioned design temperature, pressure and acoustic signal acquisition system, the entire underground coal gasification process can be properly controlled.

According to this invention, in regards to the completed well system in the sub-surface coal seam, the well liner within the well system (including injection well and production well) can be connected by any suitable method commonly used in the art, for example, connections such as welds, threads, clamp grooves, flanges, ferrules or snaps. The principle followed is to ensure best performance of the final completed well system.

According to this invention, for the above-mentioned completed well system, the injection well liner is a critical component and its function is an important guarantee for smooth operation of the underground coal gasification process.

More specifically, the importance of injection well liner is mainly reflected in the following aspects: Firstly, the horizontal well liner is not only the gas flow path for the underground coal gasification process, but also the effective pathway for conveying devices such as the oxidant nozzle; Secondly, the annulus between the injection well liner and the coal seam bore hole can also be used as a flow path, after being purged by inert gas. For example, if the coal seam is very dry and/or the gasification process requires more gasification agent, the required additional gasification agent can be injected through this flow path; Lastly, for monitoring the exact subsurface coal seam consumption location and relevant gasification process parameters, distributed temperature, pressure and acoustic sensors can be fixed on the external wall of the injection well liner to obtain corresponding temperature, pressure and acoustic signals for the distribution profiles.

According to this invention, the material for the injection well liner is generally selected based on the lithostatic pressure and hydrostatic pressure of the sub-surface formation. The inside diameter of injection well liner is generally matched with the maximum outside diameter of the oxidant nozzle. The annulus between the two can be adjusted to control the coolant flow rate when the outer diameter of the oxidant nozzle is adjustable, thereby accelerating or slowing the heat removal from the oxidant nozzle and its surroundings. The annulus between the inside wall of the injection well liner and coiled tubing is generally determined by maximum coolant flow rate to meet the coolant flow rate requirements; and the injection well liner is installed near the bottom of the coal seam, above possible partings. Generally, the injection well liner should be installed as close as possible to the bottom of the coal seam, but must not exit from the coal seam into the underlying strata. When the parting is present at the bottom of coal seam, the above-mentioned well liner is then to be installed above the parting, and it is preferred to select a continuous coal seam with approximately 1 m thickness between the well liner and parting, wherein the preferred selection of thickness for non-coal section is to be less than 15 cm, with an even more preferred selection of less than 10 cm.

According to this invention, the injection well liner and the production well liner are generally intersected at the down hole tip, and both the injection well liner and production well liner are to be perforated at the intersection to allow for product syngas to enter the production well liner through the perforations on the injection well liner, and finally to be removed from the production well.

Under these conditions, the perforated section of the above-mentioned injection well liner and production well liner includes 1-3, preferably 2, complete casing sections. The size of a perforation hole is 5-35 mm, preferably 10-25 mm. The above-mentioned perforations have a staggered spacing. The total perforated area is 5-35%, preferably 10-30%, of the total surface area of well liner perforation section. In addition, for the length of the casing section the perforations are generally at least 0.5 m away from the couplings to maintain the strength of the complete casing section.

According to this invention, the retraction method is preferably applied for the above-mentioned underground coal gasification process. When applying the retraction method during the underground coal gasification process, the gasification process usually starts from the down hole tip of the production well liner where the ignition device is initially placed through a pneumatic device interface (typically having a predetermined pneumatic pressure) disposed at the oxidant nozzle tip. When the ignition device is connected to the oxidant nozzle, it is transferred to a predetermined ignition position, followed by oxidant flow or pressure to initiate ignition, wherein delayed initiation is applied to the above-mentioned subsurface ignition device, to provide sufficient time for the oxidant nozzle to be retracted to a safe location, away from the high energy and high heat released during ignition; and wherein during the ignition phase, air (such as ≤300 $Nm^3/h$ low flow rate air) is injected through the auxiliary flow path which is the annular space between the coiled tubing and the injection well liner as the ignition oxidant. Coolant is used to replace air after the ignition and oxidant is injected through the oxidant flow path in the oxidant injection device.

According to this invention, when applying the retraction method during the underground coal gasification process, after successful ignition, the oxidant nozzle is generally required to be retracted on a regular basis for a certain distance by periodically rotating the coiled tubing reel to retract the coiled tubing to maintain the continuity of the gasification process. However, the operational flexibility of the oxidant injection device and continuity of oxidant injection in this invention are beneficial, wherein both retraction period and retraction distance can be significantly reduced. For example, the retraction period can be reduced to as short as 1 day, and the retraction distance for each retraction can be reduced to 1-10 m, preferably 1-5 m, or even more preferably 1-3 m. Oxidant such as pure oxygen and coolant can still be continuously injected during the oxidant nozzle retraction. Therefore, the real continuous underground coal gasification process in terms of operation time and reaction location in subsurface coal seam are both achieved.

According to this invention, when applying the retraction method during the underground coal gasification process, during oxidant nozzle retraction, by reducing coolant flow rate can be correspondingly reduced based on the material, wall thickness and predicted combustion speed of the liner in the injection well. Alternatively, the oxidant flow rate, such as pure oxygen, can be increased. For example, reduce the coolant flow rate by 10-80% and/or increase the pure oxygen flow rate by 10-20% to accelerate the burning rate of the injection liner portion in front of the oxidant nozzle, thereby exposing fresh coal seam for gasification. This process will continue until the sub-surface coal seam around the injection well liner is completed consumed.

Therefore, according to this invention, the improvements of the entire oxidant injection device achieves effective control of the underground coal gasification process.

Further descriptions of the embodiments in this invention are presented below with reference to the accompanying figures.

FIG. 1 is a cross sectional view of the sub-surface section of the oxidant injection device for this invention, located within an injection well liner. In FIG. 1, the oxygen nozzle body 4 is connected to a mechanical shear-off device 6, which will allow retrieval of the system, by shearing off the oxygen nozzle when it is stuck into the injection well liner 1. The mechanical shear-off device 6 is connected to a non-return valve (NRV) 7 to prevent reverse flow from entering into coiled tubing, therefore avoiding contamination of the above-mentioned device and providing safety protection when removing or retracting the device at the surface wellhead. The NRV 7 is connected to the coiled tubing 11 through an external grapple connector 8. The distributed temperature, pressure and acoustic sensing instrumentation 5 are installed on the outside of the injection well liner and on the external wall of the coiled tubing to provide indication of the thermal readings from the underground coal gasification process, the coal consumption progression along the direction of the gasification zone 12 and relative location of the oxygen nozzle 4. When the oxygen injection device is run-in-hole for the first time, a blow-off plug 3 is installed on the tip of the oxygen nozzle 4 to prevent ingress of well contaminants into the oxygen nozzle and to provide a smooth-running profile to the tool for well entry. The oxidant flow path 10 is inside coiled tubing, wherein oxidant flows to the oxidant nozzle 4 and is then injected into the gasification zone. The annular space between injection well liner and coiled tubing is the auxiliary flow path 9, wherein coolant is injected to provide coolant to the oxygen nozzle, wherein it car also be gasification agent.

Figure 2:
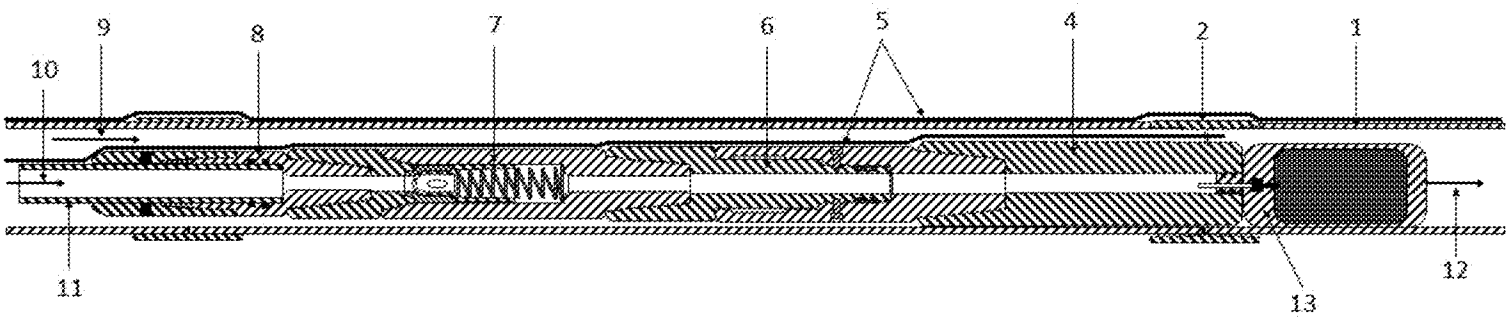
FIG. 2 is a cross sectional view of the oxidant injection device as mentioned in FIG. 1 used in the underground coal gasification ignition stage, wherein the ignition device is connected to the oxidant nozzle (the blow-off plug on the oxidant nozzle is already removed)

FIG. 2 presents another embodiment to this invention, wherein utilizing the oxidant injection device shown in FIG. 1 to conduct ignition operation for the underground coal gasification process. As shown in FIG. 2, wherein the blow-off plug 3 from FIG. 1 is removed and the pressure activated/pneumatic separated ignition device 13 is connected to the oxidant nozzle. In this embodiment, the oxidant injection device in this invention is firstly used for conveying the sub-surface ignition device 13 to the predetermined ignition location and then initiate ignition by injecting oxidant (pressure activation) and disconnecting the ignition device 13.

Figure 3:
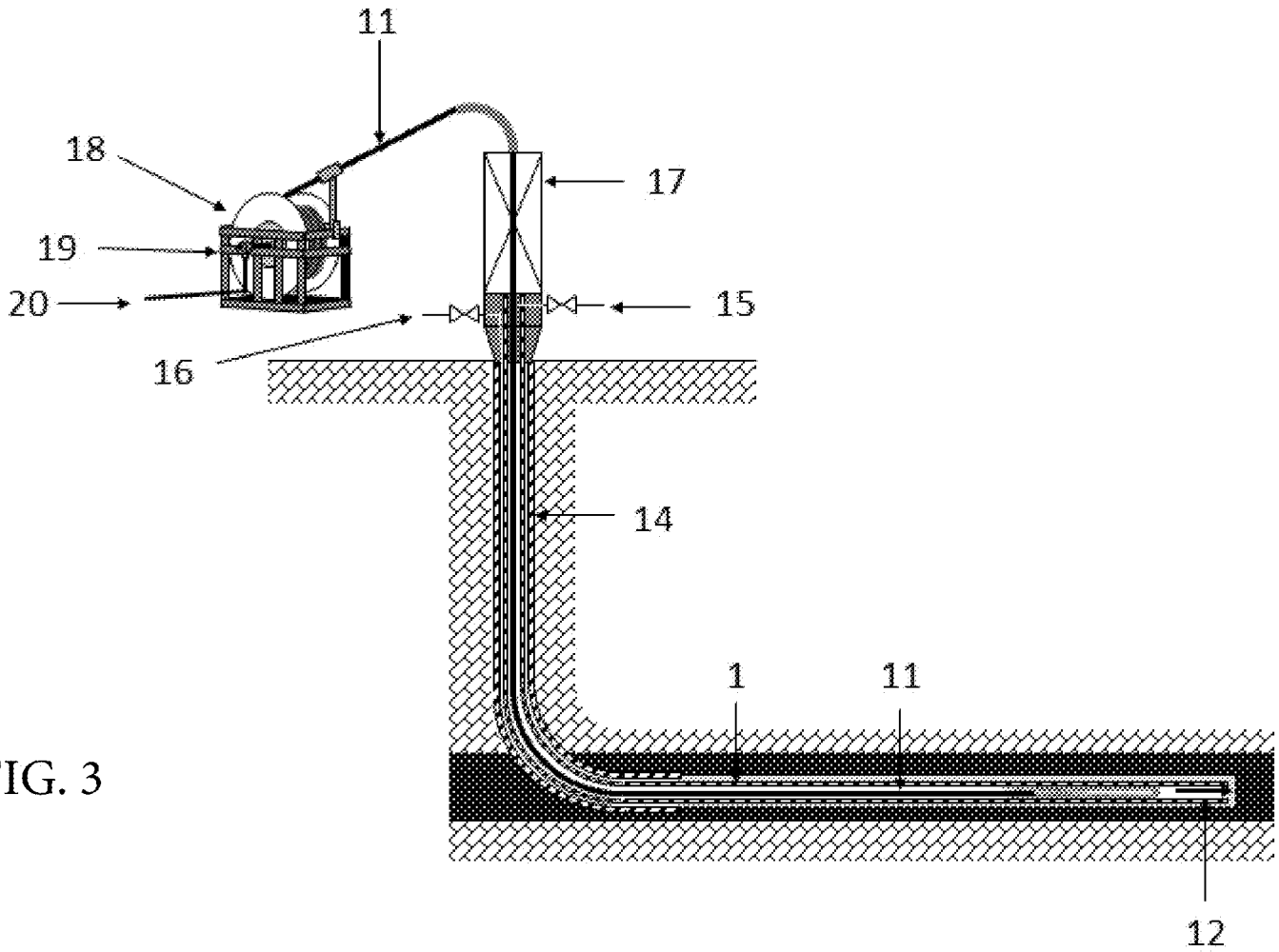
FIG. 3 is an overall cross-sectional view of the underground coal gasification method in this invention (including surface and subsurface devices).

FIG. 3 presents another embodiment to this invention (includes both surface and sub-surface devices). As shown in FIG. 3, wherein utilizing the oxidant injection device shown in FIG. 1 to conduct the underground coal gasification process, wherein coiled tubing 11 is released through the coiled tubing reel 18, enters injection well liner 1 inside the injection well casing 14 through wellhead controlling device 17, and conveys the attached oxidant nozzle to the gasification zone. The end termination of the coiled tubing 11 is inside the coiled tubing reel 18 centre shaft (not shown in the Figure). The swivel joint 19 connects the surface oxidant delivery pipeline 20 and the end termination of coiled tubing 11. This swivel joint ensures continuous oxidant injection while moving the coiled tubing when rotating the coiled tubing reel.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. An oxidant injection device used in an underground coal gasification process comprising an oxidant flow path, and gas tight connected components of the oxidant flow path in connection order: a swivel joint, a coiled tubing, a mechanical shear off device, and an oxidant nozzle, wherein the mechanical shear off device provides the capability to shear off the oxidant nozzle in the event of the oxidant nozzle becoming stuck in a subsurface well, which allows the coiled tubing to be pulled back to surface, during which the swivel joint connects a coiled tubing reel central shaft with a gas tight seal to a surface oxidant source, therefore allowing continuous oxidant injection during oxidant nozzle retraction by rotating a coiled tubing reel to enable movement of the coiled tubing.

2. The oxidant injection device of claim 1, wherein one or more non-return valves (NRV) is connected in between the coiled tubing and mechanical shear off device inside the oxidant flow path, to prevent reverse flow from entering into the coiled tubing.

3. The oxidant injection device of claim 2, wherein the coiled tubing inside the oxidant flow path is effectively connected to other parts through an external grapple connector, wherein the external grapple connector achieves a non-welded connection and provides a gas tight seal.

4. The oxidant injection device of claim 1, wherein the oxidant nozzle has an internal flow path suitable for high purity oxidant; the oxidant nozzle has an adjustable outside diameter; and the oxidant nozzle has a blow-off plug to protect the oxidant nozzle and is blown off by high pressure oxidant flow upon initiating oxidant injection.

5. The oxidant injection device of claim 4, wherein the oxidant nozzle has a nozzle tip with single hole or multiple holes, wherein the single hole tip is sized to achieve maximum exit velocity; and a plurality of holes on the multiple hole tip are parallel to or have a 5-35° angle to a central hole; and the nozzle tip is designed to have venturi flow entrainment channels at 2-20 mm width and depth at a distance from its end part, to guide coolant to the plurality of holes on the nozzle tip to allow for coolant protection.

6. A method of underground coal gasification, wherein a completed underground coal gasification well system is set up in a sub-surface coal seam; wherein using the oxidant injection device of claim 1 through an injection well to continuously inject high purity oxidant and coolant; wherein the high purity oxidant is oxygen-enriched air that contains at least 80 vol % or pure oxygen, wherein an annular space between oxygen injection devices coiled tubing and an injection well liner, is used as an auxiliary flow path to inject coolant, wherein the coolant is water, water vapor or carbon dioxide, and the coolant is also utilized as a gasification agent during a coal gasification process.

7. The method of claim 6, wherein temperature, pressure and acoustic sensors are installed outside the casing string of the injection well vertical section, outside the injection well liner, outside coiled tubing, and at oxidant nozzle, to obtain temperature, pressure and acoustic signals from subsurface coal seam combustion and gasification zone and provides feedback to a control system near a wellhead of the injection well.

8. The method of claim 7, wherein the temperature, pressure and acoustic sensors are based on a distributed sensing optic fiber in optic fiber time domain reflectometry measurement technology, wherein the optic fiber extends from the coiled tubing reel central shaft near the surface well head of the injection well to a measurement point at a far end and a Bi-metal sheathed type-K Duplex type thermocouple is added or utilized as replacement near the oxidant nozzle tip, to obtain the temperature at this point, which utilizes the information as input to control coolant flow.

9. The method of claim 6, wherein the internal diameter of the injection well liner is to match the maximum outside diameter of the oxidant nozzle; the annular space between the inside wall of a horizontal well liner and coiled tubing is determined by maximum coolant flow rate; and the injection well liner is installed near the bottom of the coal seam, and above possible partings within the coal seam.

10. The method of claim 6, wherein the injection well liner is intersected with a toe of a production well liner; both the injection well liner and the production well liner have perforations at the intersection to allow produced product gas to exit from perforations of the injection well liner and enter into the production well liner, and finally exit from a production well.

11. The method of claim 10, wherein a perforated section of the injection well liner and the production well liner includes 1-3 complete tube sections, wherein the size of a perforation hole is 5-35 mm, the perforations are aligned staggeringly with appropriate spacing, and the total perforated area is 5-35% of the total surface area of the perforated section.

12. The method of claim 6, wherein pure oxygen is used as oxidant and water or carbon dioxide is used as coolant, wherein the molar ratio of the injected coolant and the injected oxidant is 0.5-6.0.

13. The method of claim 12, wherein a retraction method is utilized in the underground coal gasification process, wherein the gasification process starts from a toe of a production well liner, wherein during initial ignition, a pneumatic device interface with pre-determined pneumatic pressure installed at the oxidant nozzle tip connects subsurface ignition device to the oxidant nozzle and transfers it to pre-determined ignition location, wherein oxidant flow or pressure is used to active the ignition with a time delay method to provide sufficient time for the oxidant nozzle to retract from the ignition location to a safe location; and wherein during the ignition stage, air is injected through the auxiliary flow path as ignition oxidant.

14. The method of claim 13, wherein after successful ignition and the underground coal gasification process starts, by regularly rotating coiled tubing reel to enable movement of the coiled tubing to retract the oxidant nozzle for a certain distance, the gasification process is maintained, wherein the shortest retraction period is 1 day, and the shortest distance for each retraction is 1 m, and wherein pure oxygen and coolant are still continuously injected during oxidant nozzle retraction.

15. The method of claim 14, further comprising steps of: reducing coolant flow and/or increasing pure oxygen flow during oxidant nozzle retraction and correspondingly based on a material type of the injection well liner, wall thickness and an expected combustion rate, to increase combustion consumption rate of the injection well liner section in front of the oxidant nozzle so that a fresh coal seam can be exposed for gasification.

* * * * *